US007864145B2

(12) United States Patent
Wu

(10) Patent No.: US 7,864,145 B2
(45) Date of Patent: Jan. 4, 2011

(54) DISPLAY UNITS AND DISPLAY PANELS OF LIGHT EMITTING DISPLAY DEVICES

(75) Inventor: Kuan-Long Wu, Hsinchu (TW)

(73) Assignee: Au Optronics Corp., Hsinchu (TW)

( * ) Notice: Subject to any disclaimer, the term of this patent is extended or adjusted under 35 U.S.C. 154(b) by 793 days.

(21) Appl. No.: 11/754,400

(22) Filed: May 29, 2007

(65) Prior Publication Data

US 2008/0100544 A1 May 1, 2008

(30) Foreign Application Priority Data

Oct. 25, 2006 (TW) ..... 95139327 A

(51) Int. Cl.
*G09G 3/32* (2006.01)

(52) U.S. Cl. ..... 345/82; 345/205

(58) Field of Classification Search ..... 345/76, 345/80, 204, 205, 82

See application file for complete search history.

(56) References Cited

U.S. PATENT DOCUMENTS

| | | | | |
|---|---|---|---|---|
| 6,930,680 | B2 * | 8/2005 | Miyazawa | 345/205 |
| 7,109,952 | B2 * | 9/2006 | Kwon | 345/76 |
| 7,365,742 | B2 * | 4/2008 | Kim et al. | 345/204 |
| 2005/0140605 | A1 * | 6/2005 | Jung | 345/76 |

* cited by examiner

*Primary Examiner*—Chanh Nguyen
*Assistant Examiner*—Kwang-Su Yang
(74) *Attorney, Agent, or Firm*—Thomas, Kayden, Horstemeyer & Risley

(57) ABSTRACT

A display unit and a display panel are provided. In the display panel, uneven images caused by the electrical difference between driving transistors within the display unit are prevented through increasing the number of switch elements within the display unit and the number of scan signals and controlling data signals. Moreover, unequal brightness resulted from the disposition of the power lines is also prevented.

20 Claims, 9 Drawing Sheets

DISPLAY UNITS AND DISPLAY PANELS OF LIGHT EMITTING DISPLAY DEVICES

This application claims the benefit of Taiwan Patent Application Serial No. 095139327 filed Oct. 25, 2006, the subject matter of which is incorporated herein by reference.

BACKGROUND

The present invention relates to a display panel, and in particular, to a display panel employed in an organic light emitting display device.

FIG. 1 is a schematic diagram of a conventional organic light emitting display panel. As shown in FIG. 1, a panel 1 comprises a data driver 11, a scan driver 12, and a display array 13. The data driver 11 controls a plurality of data lines $DL_1$ to $DL_n$, and the scan driver 12 controls a plurality of scan lines $SL_1$ to $SL_m$. Interlaced data lines $DL_1$ to $DL_n$ and scan lines $SL_1$ to $SL_m$ form a display array 13. Each pair of the interlaced data line and scan line corresponds to a display unit. For example, the interlaced data line $DL_1$ and scan line $SL_1$ correspond to a display unit 100. As with any other display unit, the equivalent circuit of the display unit 100 comprises a switch transistor T11, a storage capacitor Cs1, a driving transistor T12, and an organic light-emitting diode (OLED) D1. The driving transistor T12 is a PMOS transistor, for example.

The scan driver 12 sequentially outputs scan signals to the scan lines $SL_1$ to $SL_m$ to turn on the switch transistors within all display units corresponding to one row and turn off the switch transistors within all display units corresponding to all other rows. The data driver 11 outputs video signals with gray scale values to the display units corresponding to one row through the data lines $DL_1$ to $DL_n$ according to prepared but not yet displayed image data. For example, when the scan driver 12 outputs a scan signal to the scan line $SL_1$, the switch transistor T11 within the display unit 100 is turned on. The data driver 11 then outputs a corresponding video signal to the display unit 100 through the data line $DL_1$, and the storage capacitor Cs1 stores the voltage of the video signal. The driving transistor T12 provides a driving current Id1 to drive the OLED D1 to emit light according to the stored voltage in the storage capacitor Cs1.

Because the OLED D1 is a current-driving element, the brightness of the OLED D1 is determined by the intensity of the driving current Id1. The driving current Id1 is a drain current of the driving transistor T12 and refers to the driving capability thereof. The driving current Id1 is represented by the following equation:

$$id1=k(vsg+vth)^2$$

where id1, k, vsg and vth represent a value of the driving current Id1, a conductive parameter of the driving transistor T12, a value of the source-gate voltage Vsg of the driving transistor T12, and a threshold voltage of the driving transistor T12 respectively.

Because the driving transistors in different regions of the display array 13 are not electrically identical due to the fabrication process thereof, the threshold voltages of the driving transistors are unequal. When the display units within different regions receive the same video signal, the driving current respectively provided by the driving transistors of the display units is not equal due to the unequal threshold voltages of the driving transistors. Thus, brightness of the OLEDs is not equal, resulting in unequal OLED light-emission intensity in a frame cycle and uneven images displayed on the panel 1.

Referring to FIG. 2, because the driving transistor T12 is a PMOS transistor, an input port 21 of a power line on the panel 1 is coupled to a voltage source Vdd. A person having ordinary skill in the art will recognize that the input port 21 of the power line is coupled to a voltage source Vss when the driving transistor T12 is an NMOS transistor. According to the disposition of the power lines on the panel 1, the display unit, which farther from the input port 21, corresponds to greater equivalent resistance of the power line. Thus, because the display unit is closer to the input port 21, brightness is greater, while the brightness of the display unit farther from the input port 21 is less bright, resulting in unequal brightness.

SUMMARY

Display units are provided. An exemplary embodiment of a display unit comprises first to fourth switch elements, a driving element, a storage capacitor, and a light-emitting element. The first switch element comprises a first terminal for receiving a data signal and a second terminal electrically coupled to a first node. The second switch element has a first terminal electrically coupled to the first node and a second terminal electrically coupled to a second node. The driving element has a control terminal electrically coupled to the second node, a first terminal electrically coupled to a third node, and a second terminal electrically coupled to a fourth node. The storage capacitor is electrically coupled between the first and third nodes. The third switch element has a first terminal electrically coupled to the second node and a second terminal electrically coupled to the fourth node. The fourth switch element has a first terminal electrically coupled to a first voltage source and a second terminal electrically coupled to the third node. The light-emitting element is electrically coupled between the fourth node and a second voltage source.

Display panels are provided. An exemplary embodiment of a display panel comprises a plurality of data lines, a plurality of first scan lines, a plurality of second scan lines, a plurality of display units. The data lines are disposed sequentially and respectively transmit a plurality of data signals. The first scan lines are disposed sequentially and interlaced with the data lines and transmit a respectively plurality of first scan signals. The second scan lines are disposed sequentially and interlaced with the data lines and respectively transmit a plurality of second scan signals. The display units are disposed in a plurality of rows and columns. The display units in one row are electrically coupled to the same first and second scan lines, and each display unit corresponds one set of the interlaced data line, first scan line, and second scan line.

Each display unit comprises first to fourth switch elements, a driving element, a storage capacitor, and a light-emitting element. The first switch element has a control terminal coupled to the corresponding first scan line, a first terminal electrically coupled to the corresponding data line, and a second terminal electrically coupled to a first node. The second switch element has a control terminal electrically coupled to the corresponding second scan line, a first terminal electrically coupled to the first node, and a second terminal electrically coupled to a second node. The driving element has a control terminal electrically coupled to the second node, a first terminal electrically coupled to a third node, and a second terminal electrically coupled to a fourth node. The storage capacitor is electrically coupled between the first and third nodes. The third switch element has a control terminal electrically coupled to the corresponding first scan line, a first terminal electrically coupled to the second node, and a second terminal electrically coupled to the fourth node. The fourth switch element has a control terminal electrically coupled to the corresponding second scan line, a first terminal electrically coupled to a first voltage source, and a second terminal electrically coupled to the third node. The light-emitting element is electrically coupled between the fourth node and a second voltage source.

DESCRIPTION OF THE DRAWINGS

The present invention will become more fully understood from the detailed description given hereinbelow and the accompanying drawings, given by way of illustration only and thus not intended to be limitative of the present invention, where.

DETAILED DESCRIPTION

Figure 1:
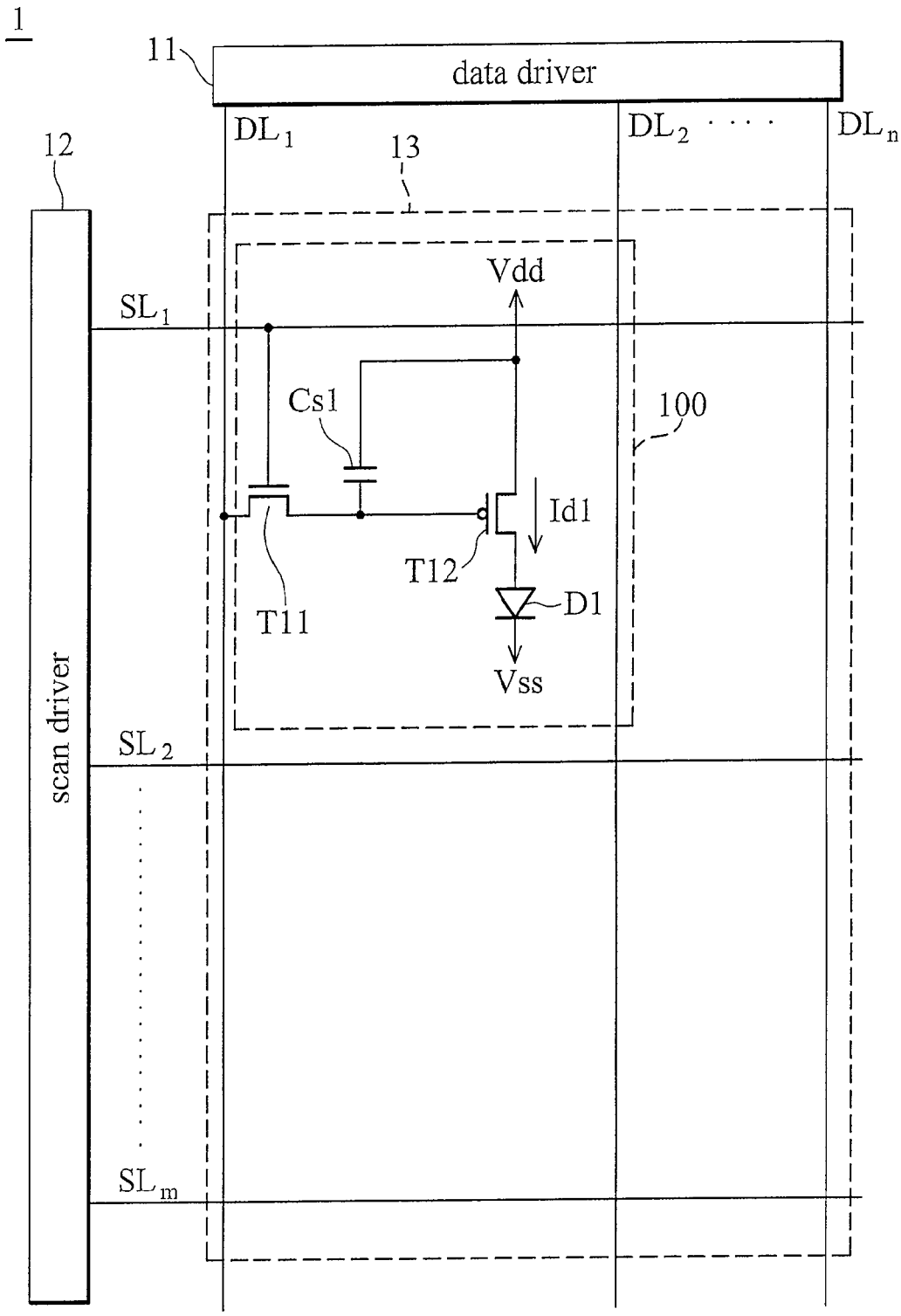
FIG. 1 (RELATED ART)
FIG. 1 shows a conventional organic light emitting display panel.
Figure 2:
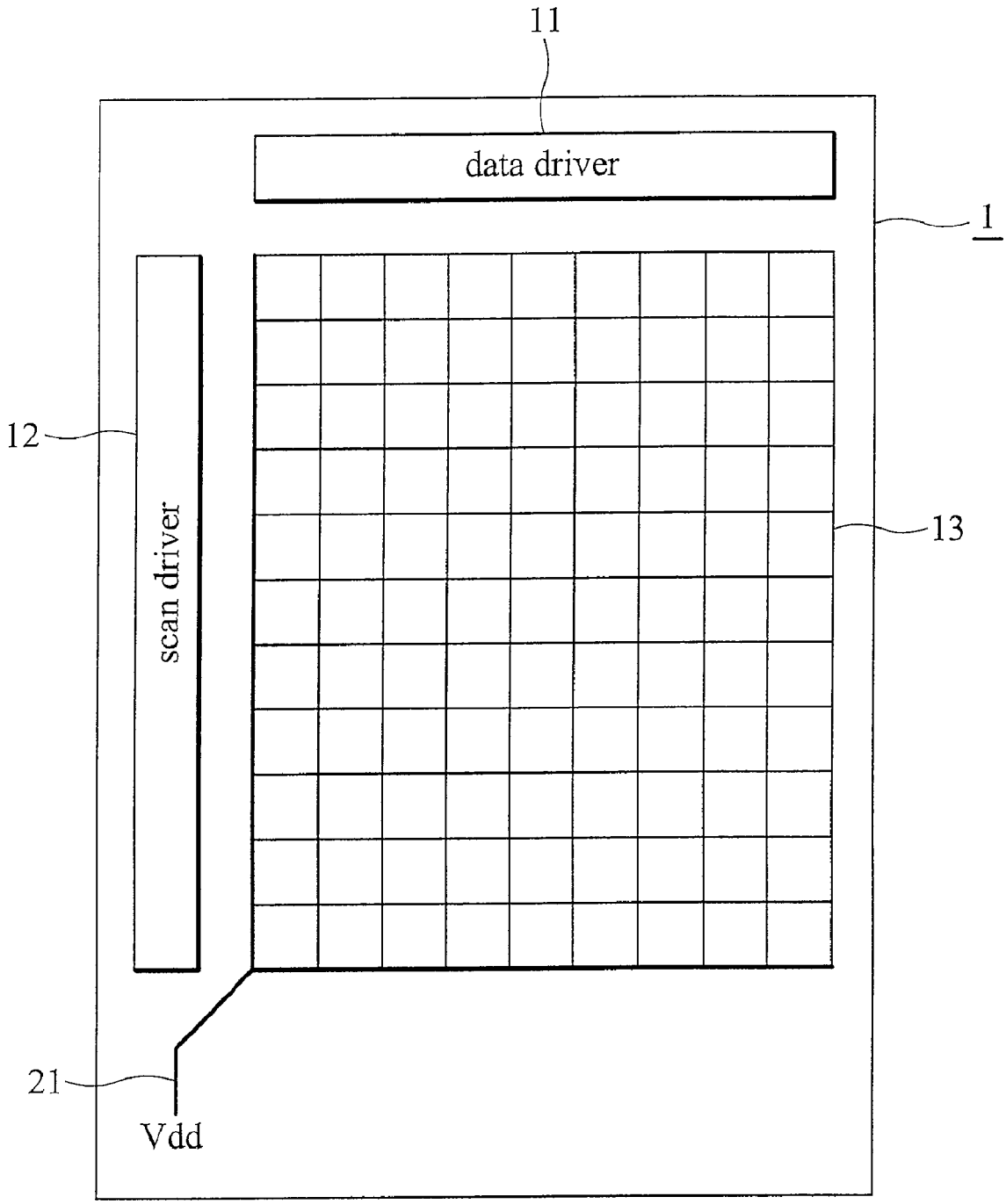
FIG. 2 (RELATED ART)
FIG. 2 shows a circuit disposition of power lines in the display panel of FIG. 1.
Figure 3:
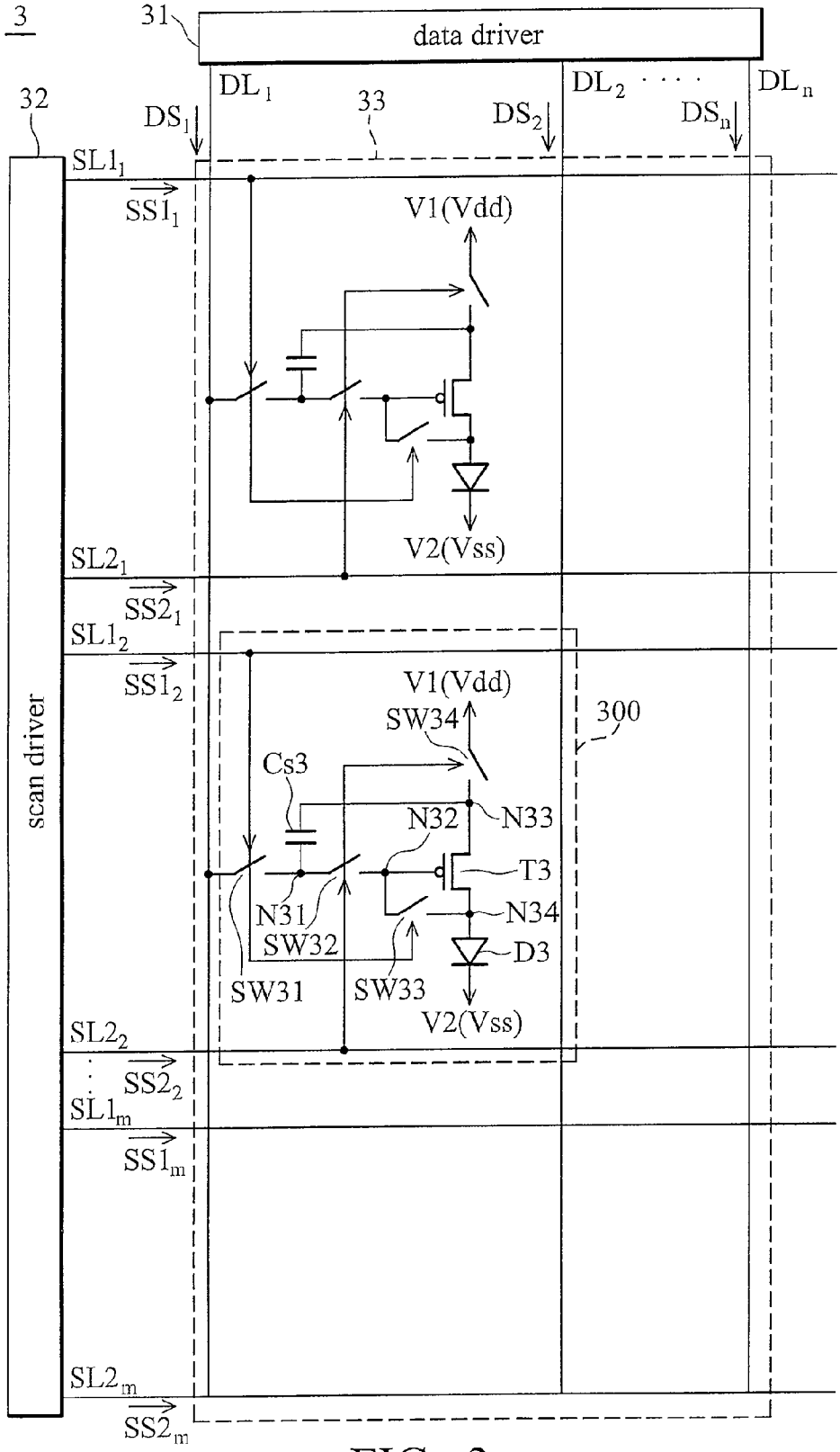
FIG. 3 depicts a display panel according to an embodiment of the present invention.

Display panels are provided. An exemplary embodiment of a display panel, as illustrated in FIG. 3, comprises a data driver 31, a scan driver 32, a display array 33, sequentially disposed data lines $DL_1$ to $DL_n$, sequentially disposed first scan lines $SL1_1$ to $SL1_m$, and sequentially disposed second scan lines $SL2_1$ to $SL2_m$. The display array 33 is formed by the interlaced data lines $DL_1$ to $DL_n$, first scan lines $SL1_1$ to $SL1_m$, and second scan lines $SL2_1$ to $SL2_m$. The interlaced data line, first scan line, and second scan line correspond to a display unit. For example, the interlaced data line $DL_1$, first scan line $SL1_2$, and second scan line $SL2_2$ correspond to a display unit 300. As shown in FIG. 3, the display units on one row are electrically coupled to the same first and second scan lines. For example, the display unit 300 and all other display units disposed on the same row are electrically coupled to the first scan line $SL1_2$ and second scan line $SL2_2$. The data driver 31 provides data signals $DS_1$ to $DS_n$ through the data lines $DL_1$ to $DL_n$, respectively. The scan driver 32 provides first scan signals $SS1_1$ to $SS1_m$ respectively through the first scan lines $SL1_1$ to $SL1_m$ and provides second scan signals $SS2_1$ to $SS2_m$ respectively through the second scan lines $SL2_1$ to $SL2_m$.

Referring to FIG. 3, like any other display unit, the equivalent circuit of the display unit 300 comprises first to fourth switch elements SW31 to SW34, a storage capacitor Cs3, a driving element T3, and a light-emitting element D3.

As shown in FIG. 3, in the display unit 300, a control terminal of the first element SW31 is electrically coupled to the first scan line $SL1_2$, a first terminal (such as an input terminal) thereof is electrically coupled to the data line $DL_1$, and a second terminal (such as an output terminal) thereof is electrically coupled to a first node N31. A control terminal of the second element SW32 is electrically coupled to the second scan line $SL2_2$, a first terminal (such as an input terminal) thereof is electrically coupled to the first node N31, and a second terminal (such as an output terminal) thereof is electrically coupled to a second node N32. A control terminal of the third element SW33 is electrically coupled to the first scan line $SL1_2$, a first terminal (such as an input terminal) thereof is electrically coupled to the second node N32, and a second terminal (such as an output terminal) thereof is electrically coupled to a fourth node N34. A control terminal of the fourth element SW34 is electrically coupled to the second scan line $SL2_2$, a first terminal (such as an input terminal) thereof is electrically coupled to a first voltage source V1, and a second terminal (such as an output terminal) thereof is electrically coupled to the third node N33.

The storage capacitor Cs3 is electrically coupled between the first node N31 and the third node N33. A gate (control terminal) of the driving element T2 is electrically coupled to the second node N32, a source (first terminal) thereof is electrically coupled to the third node N33, and a drain (second terminal) thereof is electrically coupled to the fourth node N34. The light-emitting element D3 is electrically coupled between the fourth node N34 and a second voltage source V2. In the embodiment of FIG. 3, the first voltage source V1 is implemented by a voltage source Vdd, and the second voltage source V2 is implemented by a voltage source Vss.

Figure 4:
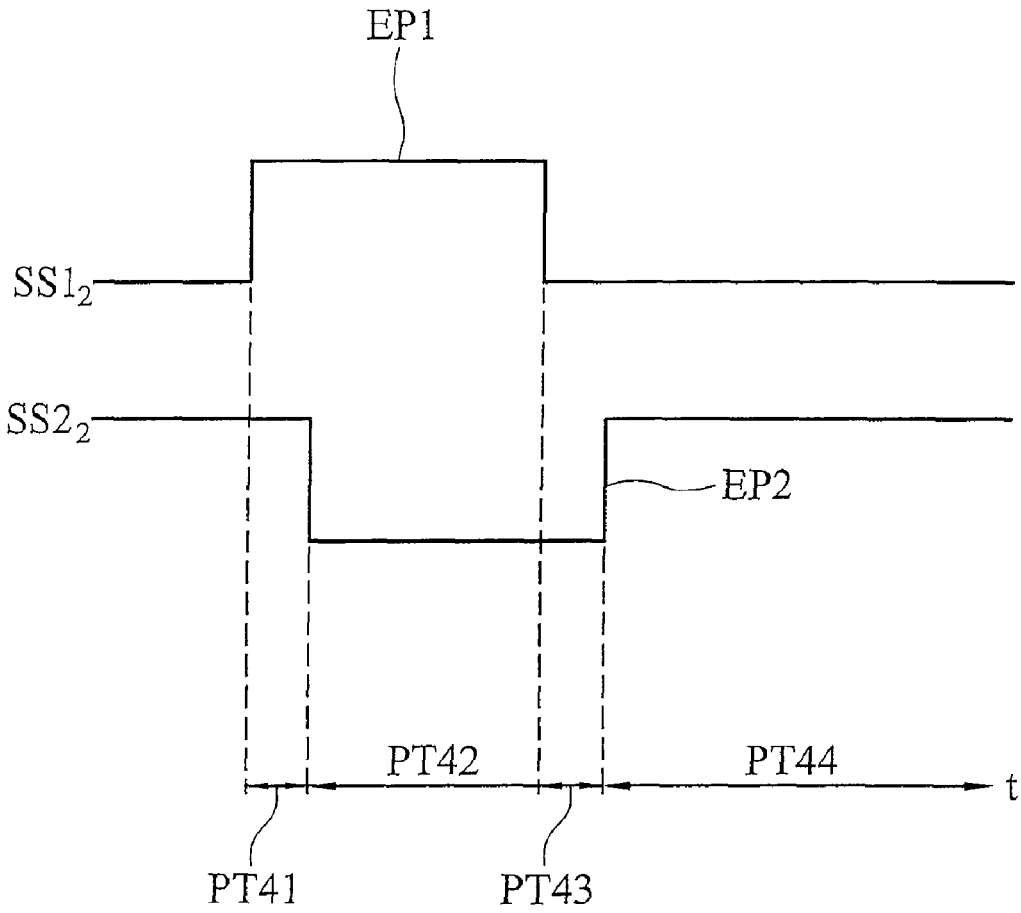
FIG. 4 is a timing chart of first and second scan signals, according to an embodiment of the present invention.

FIG. 4 is a timing chart of the first and second scan signals in the embodiment of FIG. 3. In FIG. 4, the first scan signal $SS1_2$ and the second scan signal $SS2_2$ corresponding to the display unit 300 of FIG. 3 are given as an example. To describe the timing of the first scan signal $SS1_2$ and the second scan signal $SS2_2$ of FIG. 4, the first to fourth switch elements SW31 to SW34 within the display unit 300 are implemented by NMOS transistors, for example. The first scan signal $SS1_2$ and the second scan signal $SS2_2$ are inverse. An enabling pulse EP2 of the second scan signal $SS2_2$ is delayed from an enabling pulse EP1 of the first scan signal $SS1_2$ for a predetermined period PT41.

Figure 5A:
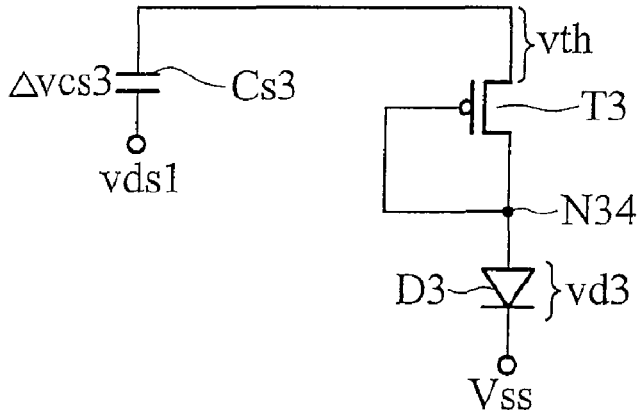
FIGS. 5*a* and 5*b* show equivalent circuits of the display unit in FIG. 3 in different periods.

Referring FIG. 4, in the period PT41, because the first scan signal $SS1_2$ and the second scan signal $SS2_2$ are at a high level, the first to fourth switch elements SW31 to SW34 are turned on. The storage capacitor Cs3 is charged by the voltage source Vdd and stores a predetermined voltage. Thus, before the data signal $DS_1$ is written into the display unit 300, all the storage capacitors within the display unit 300 and the other display units disposed in the same row have a common state, which is advantageous in subsequent normal writing. In a period PT42 following the period PT41, the first scan signal $SS1_2$ remains at high level, and the second scan signal $SS2_2$ changes to a low level. The first and third switch element SW31 and SW33 thus remain turned on, and the second and fourth switch elements SW32 and SW34 are turned off. At this time, the data signal $DS_1$ is written into the storage capacitor Cs3. The equivalent circuit of the display unit 300 in the period PT42 is shown in FIG. 5*a*, and the cross voltage between two terminals of the storage capacitor Cs3, that is, the voltage stored in the storage capacitor Cs3, is represented by Equation 1:

$$\Delta vcs3=[vss-(-vd3)-vth]-vds1 \quad \text{(Equation 1)}$$

where Δvsd3, vss, vd3, vth, and Δvds1 represent the cross voltage between two terminals of the storage capacitor Cs3, a voltage value of the voltage source Vss, the cross voltage between of the light-emitting element D3, a threshold voltage of the driving element T3, and a voltage value of the data signal $DS_1$, respectively.

Figure 5B:
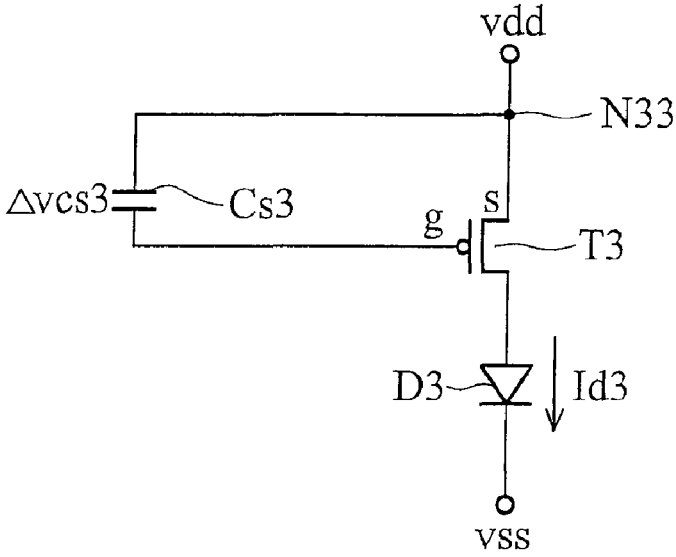

In a period PT43 following the period PT42, the first scan signal $SS1_2$ and the second scan signal $SS2_2$ are at the low level, and thus the first to fourth switch elements SW31 to SW34 are turned off. Writing of the data signal $DS_1$ into the storage capacitor Cs3 is stopped. In a period PT44 following the period PT43, the first scan signal $SS1_2$ remains at the low level, and the second scan signal $SS2_2$ changes to the high level. The first and third switch elements SW31 and SW33 are thus turned off, and the second and the fourth switch elements SW32 and SW34 are thus turned on. At this time, the driving element T3 provides the driving current Id3 according to the voltage stored in the storage capacitor Cs3 to drive the light-emitting element D3. The equivalent circuit of the display unit 300 in the period PT44 is shown in FIG. 5*b*. Due to charge conservation, the cross voltage of the storage capacitor Cs3 in the period PT42 is equal to that in the period PT44. Equation 2 is thus obtained according to Equation 1:

$$\Delta vcs3=[vss-(-vd3)-vth]-vds1=vsg \quad \text{(Equation 2)}$$

where vsg represents a value of the source-gate voltage Vsg of the driving element T3.

Because the light-emitting element D3 is a current-driven element, the brightness provided by the light-emitting element D3 is determined according to the value of the driving current Id3. The driving current Id3 is equal to the drain current of the driving element T3, and Equation 3 is thus obtained as follows:

$$id3\propto(vsg+vth)^2 \quad \text{(Equation 3)}$$

where id3 represents a value of the driving current Id3.

According to Equation 2 and Equation 3, Equation 4 is obtained as follows:

$$id3\propto\{[vss-(-vd3)-vth]-vds1+vth\}=(vss+vd3-vds1). \quad \text{(Equation 4)}$$

According to Equation 4, the threshold voltage of the driving element T3 does not affect the driving current Id3. In other words, the electrical difference of the driving transistors due to the fabrication process thereof does not affect the brightness of the light-emitting element D3, thus, uneven images are prevented. Moreover, according to Equation 4, the voltage source Vdd does not affect the driving current Id3, thus, unequal brightness resulting from the disposition of the power lines is prevented.

Figure 6:
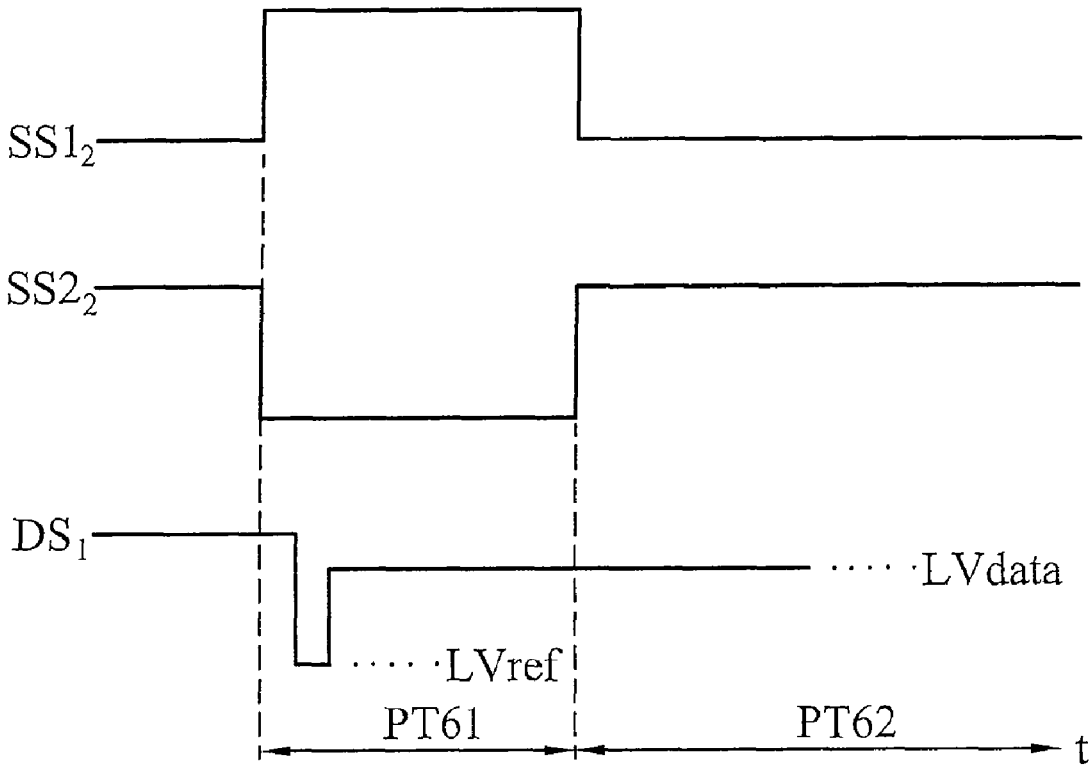
FIG. 6 is a timing chart of first and second scan signals and a data signal, according to an embodiment of the present invention.

FIG. 6 is a timing chart of the first scan signal, the second scan signal, and the data signal applied in the display panel 3, according to an embodiment of the present invention. In FIG. 6, the first scan signal $SS1_2$, the second scan signal $SS2_2$, and the data signal $DS_1$ corresponding to the display unit 300 are given as examples, and the timing of the first scan signal $SS1_2$ and the second scan signal $SS2_2$ in FIG. 6 is different from that in FIG. 4. To describe the timing of the first scan signal $SS1_2$ and the second scan signal $SS2_2$ of FIG. 6, the first to fourth switch elements SW31 to SW34 are implemented by NMOS transistors, for example. The first scan signal $SS1_2$ and the second scan signal $SS2_2$ are inverse.

Referring to FIG. 6, in a period PT61, the first scan signal is at a high level, and the second scan signal is at a low level. The first and third switch elements SW31 and SW33 are thus turned on, and the second and fourth switch elements SW32 and SW34 are thus turned off. The equivalent circuit of the display unit 300 in the period PT61 is shown in FIG. 5*a*. At this time, the data signal $DS_1$ is written into the storage capacitor Cs3. Note that the voltage of the data signal $DS_1$ is at a reference level LVref first and then changes to a data level LVdata. When the voltage of the data signal $DS_1$ is at the reference level LVref, the storage capacitor Cs3 stores voltage with the reference level LVref. Thus, before the data signal $DS_1$ is written into the display unit 300, all the storage capacitors within the display unit 300 and the other display units disposed in the same row are discharged according to the reference level LVref and have a common state. In other words, the storage capacitors store the voltage with the reference level LVref, which is advantageous for subsequent normal writing.

When the voltage of the data signal $DS_1$ changes to the data level LVdata, the storage capacitor Cs3 is charged according to the data level LVdata. The final cross voltage of the storage capacitor Cs3 is represented by Equation 1:

$$\Delta vcs3=[vss-(-vd3)-vth]-vds1. \quad \text{(Equation 1)}$$

In a period PT62 following the period PT61, the first scan signal $SS1_2$ changes to the low level to turn off the first and third switch elements SW31 and SW33, while the second scan signal $SS2_2$ changes to the high level to turn on the second and fourth switch elements SW32 and SW34. At this time, the driving element T3 provides the driving current Id3 according to the voltage stored in the stage capacitor Cs3 to drive the light-emitting element D3. The equivalent circuit of the display unit 300 in the period PT62 is shown in FIG. 5*b*. Due to charge conservation, the final cross voltage of the storage capacitor Cs3 in the period PT61 is equal to that in the period PT62. Equation 2 is thus obtained according to Equation 1:

$$\Delta vcs3=[vss-(-vd3)-vth]-vds1=vsg. \quad \text{(Equation 2)}$$

Because the light-emitting element D3 is a current-driven element, the brightness provided by the light-emitting element D3 is determined according to the value of the driving current Id3. The driving current Id3 is equal to drain current of the driving element T3, and Equation 3 is thus obtained as follows:

$$id3\propto(vsg+vth)^2. \quad \text{(Equation 3)}$$

According to Equation 2 and Equation 3, Equation 4 is obtained as follows:

$$id3\propto\{[vss-(vd3)-vth]-vds1+vth\}=(vss+vd3-vds1). \quad \text{(Equation 4)}$$

According to Equation 4, the threshold voltage of the driving element T3 does not affect the driving current Id3. In other words, the electrical difference between the driving transistors due to the fabrication process thereof does not affect the brightness of the light-emitting element D3, thus, uneven images are prevented. Moreover, according to Equation 4, the voltage source Vdd does not affect the driving current Id3, preventing unequal brightness resulting from the disposition of the power lines.

According to the timing chart of the first scan signal $SS1_2$, the second scan signal $SS2_2$, and the data signal $DS_1$ in FIG. 6, for all the display units, the voltage of all the data signals is at the reference LVref first. Before a data signal with the data level LVdata is written into a corresponding display unit, a storage capacitor within the corresponding display unit is discharged according to the reference level LVref. The data driver 31 accordingly has a pre-charging function.

Figure 7:
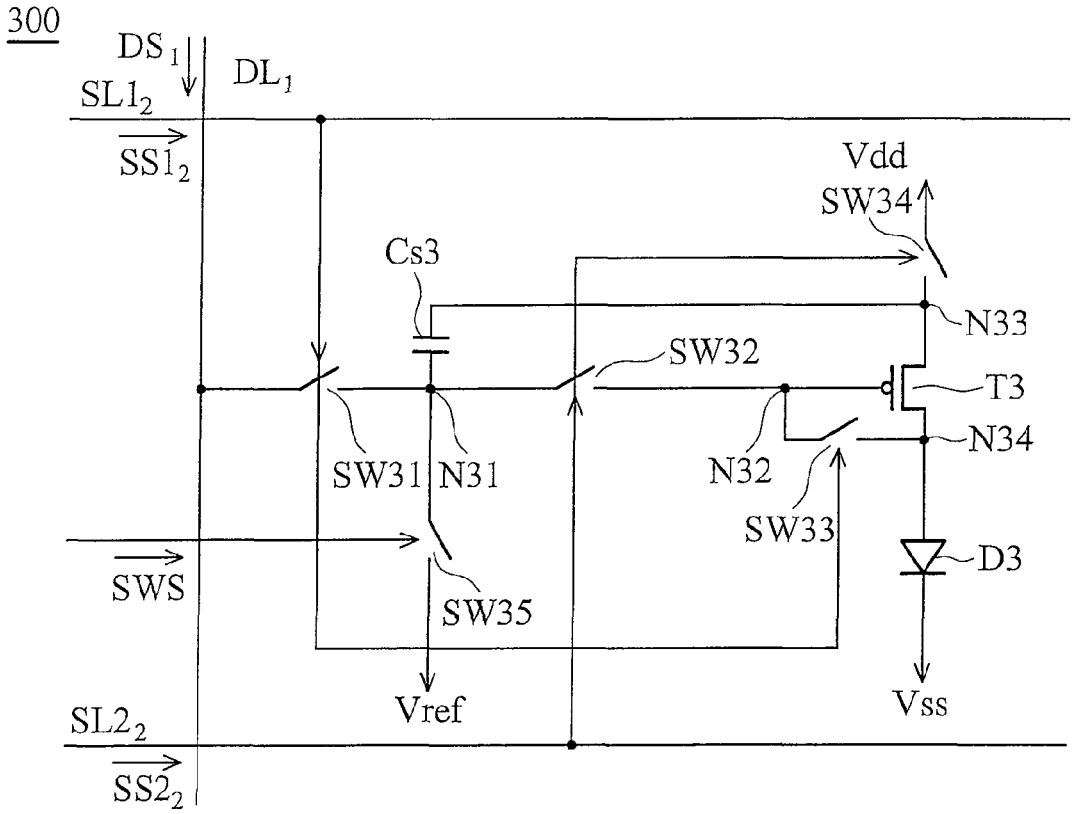
FIG. 7 depicts a display unit according to an embodiment of the present invention.
Figure 8:
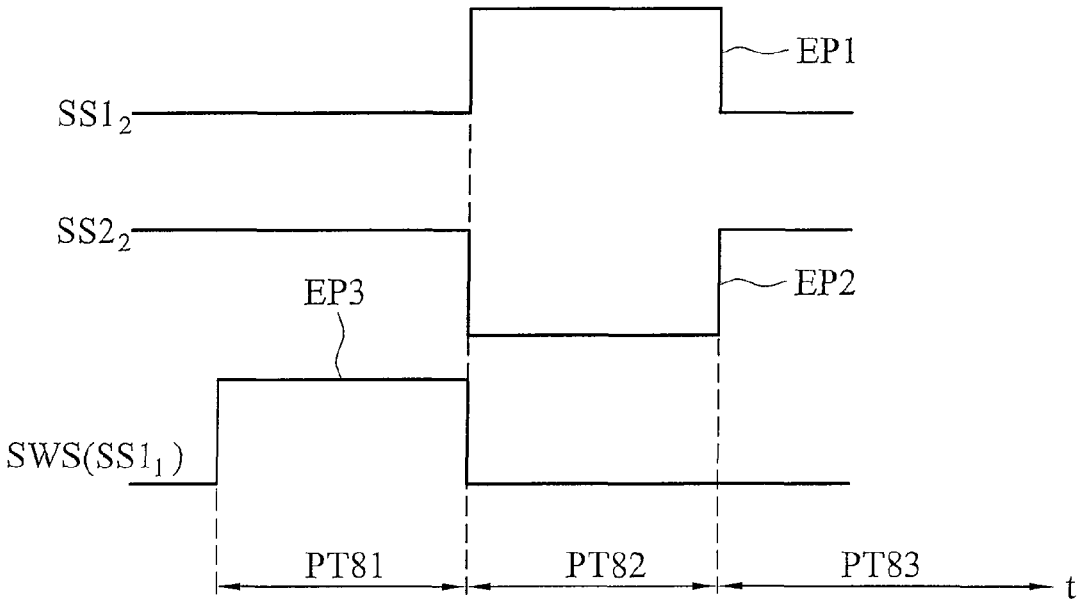
FIG. 8 is a timing chart of first and second scan signals and a switch signal, according to an embodiment of the present invention.

In some embodiments, as shown in FIG. 7, the display unit 300 further comprises a fifth switch element SW35. A control terminal of the fifth switch element SW35 receives a switch signal SWS, a first terminal (such as an input terminal) thereof is electrically coupled to the first node N31, and a second terminal (such as an output terminal) thereof is electrically coupled the reference voltage source Vref. FIG. 8 is a timing chart of an embodiment of the first scan signal, the second scan signal, and the switch signal applied in the display panel 3 in FIG. 7. In FIG. 8, the first scan signal $SS1_2$, the second scan signal $SS2_2$, and the switch signal SWS corresponding to the display unit 300 are given as an example. The first to fifth switch elements SW31 to SW35 are NMOS transistors. The first scan signal $SS1_2$ and the second scan signal $SS2_2$ are inverse.

Referring to FIG. 8, in a period PT81, the first scan signal $SS1_2$ is at a low level to turn off the first and third switch elements SW31 and SW33. The second scan signal $SS2_2$ is at a high level to turn on the second and fourth switch elements SW32 and SW34. The switch signal SWS is at the high level, meaning that an enabling pulse EP3 appears in the switch signal SWS, to turn on the fifth switch element SW5. The storage capacitor Cs3 is discharged according to a reference voltage source Vref. Thus, the storage capacitors within the display unit 300 and the other display units disposed in the same row have a common state before the data signal are written into the storage capacitors, which is advantageous to subsequent normal writing.

In a period PT82 following the period PT81, the first scan signal $SS1_2$ changes to the high level, meaning that an enabling pulse EP1 appears in the first scan signal $SS1_2$, to turn on the first and third switch elements SW31 and SW33. The second scan signal SW32 and the switch signal SWS change to the low level to turn off the second, fourth and fifth switch elements SW32, SW34, and SW35. At this time, the data signal $DS_1$ is written into the storage capacitor Cs3. The equivalent circuit of the display unit 300 in the period PT82 is shown in FIG. 5*a*, and Equation 1 represents the cross voltage between two terminals of the storage capacitor Cs3:

$$\Delta vcs3=[vss-(-vd3)-vth]-vds1. \quad \text{(Equation 1)}$$

In a period PT83 subsequent to the period PT82, the first scan signal $SS1_2$ changes to the low level to turn off the first and third switch elements SW31 and SW33. The second scan signal $SS2_2$ changes to the high level, thus, an enabling pulse EP2 appears in the second scan signal $SS1_2$, to turn on the second and fourth switch elements SW32 and SW34. The switch signal SWS remains at the low level. The driving element T3 provides the driving current Id3 according to the voltage stored in the storage capacitor Cs3 to drive the light-emitting element D3. The equivalent circuit of the display unit 300 in the period PT83 is shown in FIG. 5*b*. Due to charge conservation, the cross voltage of the storage capacitor Cs3 in the period PT82 is equal to that in the period PT83. Equation 2 is thus obtained according to Equation 1:

$$\Delta vcs3=[vss-(-vd3)-vth]-vds1=vsg. \quad \text{(Equation 2)}$$

Because the light-emitting element D3 is a current-driven element, the brightness provided by the light-emitting element D3 is determined according to the value of the driving current Id3. The driving current Id3 is equal to drain current of the driving element T3, and Equation 3 is thus obtained as follows:

$$id3\propto(vsg+vth)^2. \quad \text{(Equation 3)}$$

According to Equation 2 and Equation 3, Equation 4 is obtained as follows:

$$id3\propto\{[vss-(vd3)-vth]-vds1+vth\}=(vss+vd3-vds1). \quad \text{(Equation 4)}$$

According to Equation 4, the threshold voltage of the driving element T3 does not affect the driving current Id3. In other words, the electrical difference of the driving transistors due to the fabrication process thereof does not affect the brightness of the light-emitting element D3, preventing uneven images. Moreover, according to Equation 4, the voltage source Vdd also does not affect the driving current Id3, preventing unequal brightness resulting from the disposition of the power lines.

According to FIG. 8, because the enabling pulse EP1 of the first scan signal $SS1_2$ follows the enabling pulse EP3 of the switch signal SWS, the switch signal SWS can be implemented by the first scan signal $SS1_1$ corresponding to the display units in the preceding row to the row in which the display unit 300 is disposed. In other words, in the display unit 300, the control terminal of the fifth switch SW35 can be coupled to the first scan line $SL1_1$ to receive the first scan signal $SS1_1$.

Figure 9:
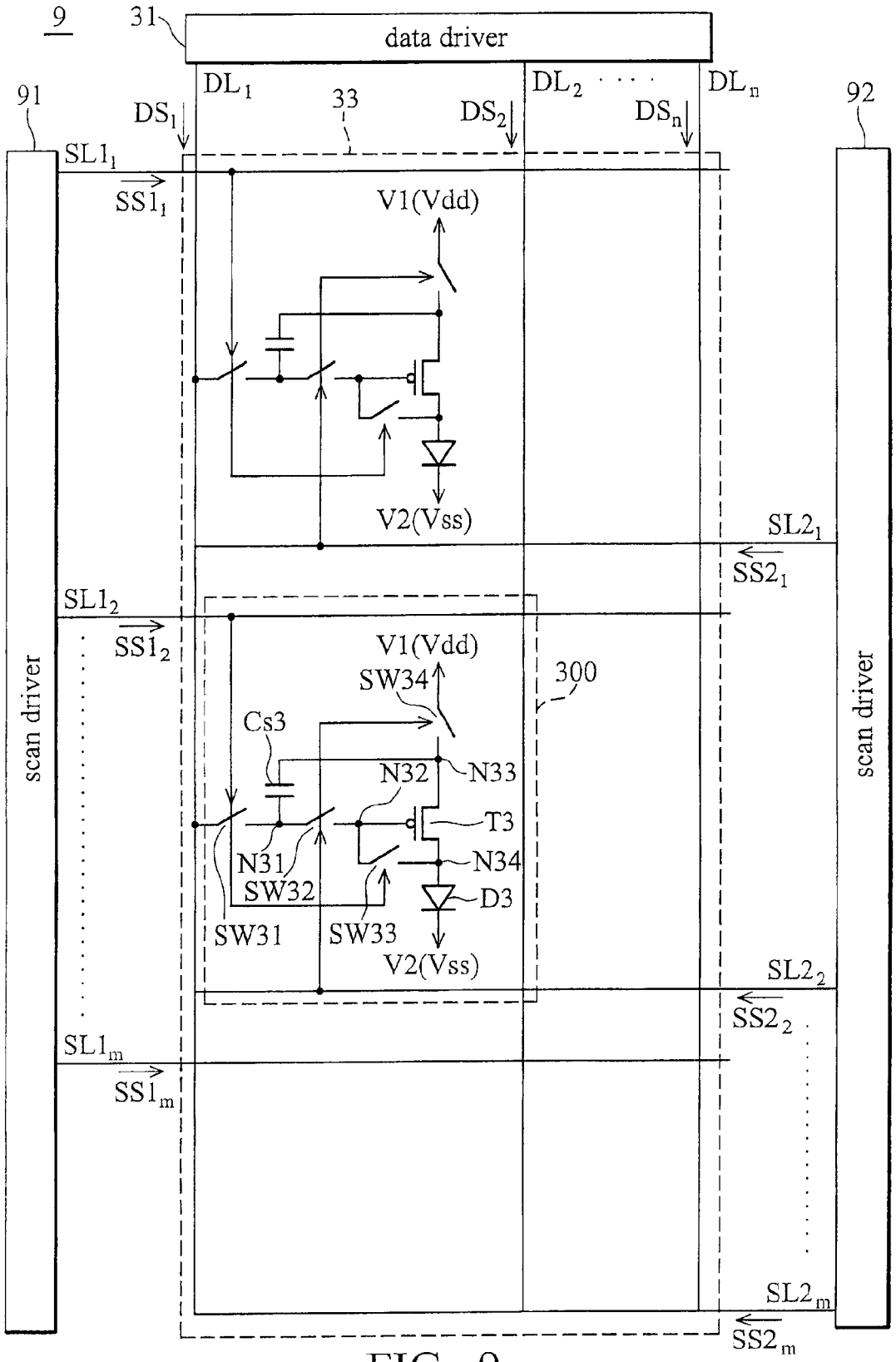
FIG. 9 depicts a display panel according to an embodiment of the present invention.

Referring to FIG. 3, the first scan signals $SS1_1$ to $SS1_m$ and the second scan signals $SS2_1$ to $SS2_2$ are provided by the scan driver 32. In some embodiments, however, the first scan signals $SS1_1$ to $SS1_m$ and the second scan signals $SS2_1$ to $SS2_2$ can be respectively provided by two different scan drivers. Referring to FIG. 9, the difference between the display panel 9 in FIG. 9 and the display panel 3 in FIG. 3 is that the display panel 9 comprises two scan drivers 91 and 92. The scan driver 91 respectively provides the first scan signals $SS1_1$ to $SS1_m$ to the first scan lines $SL1_1$ to $SL1_m$, and the scan driver 92 respectively provides the second scan signals $SS2_1$ to $SS2_m$ to the first scan lines $SL2_1$ to $SL2_m$.

Figure 10:
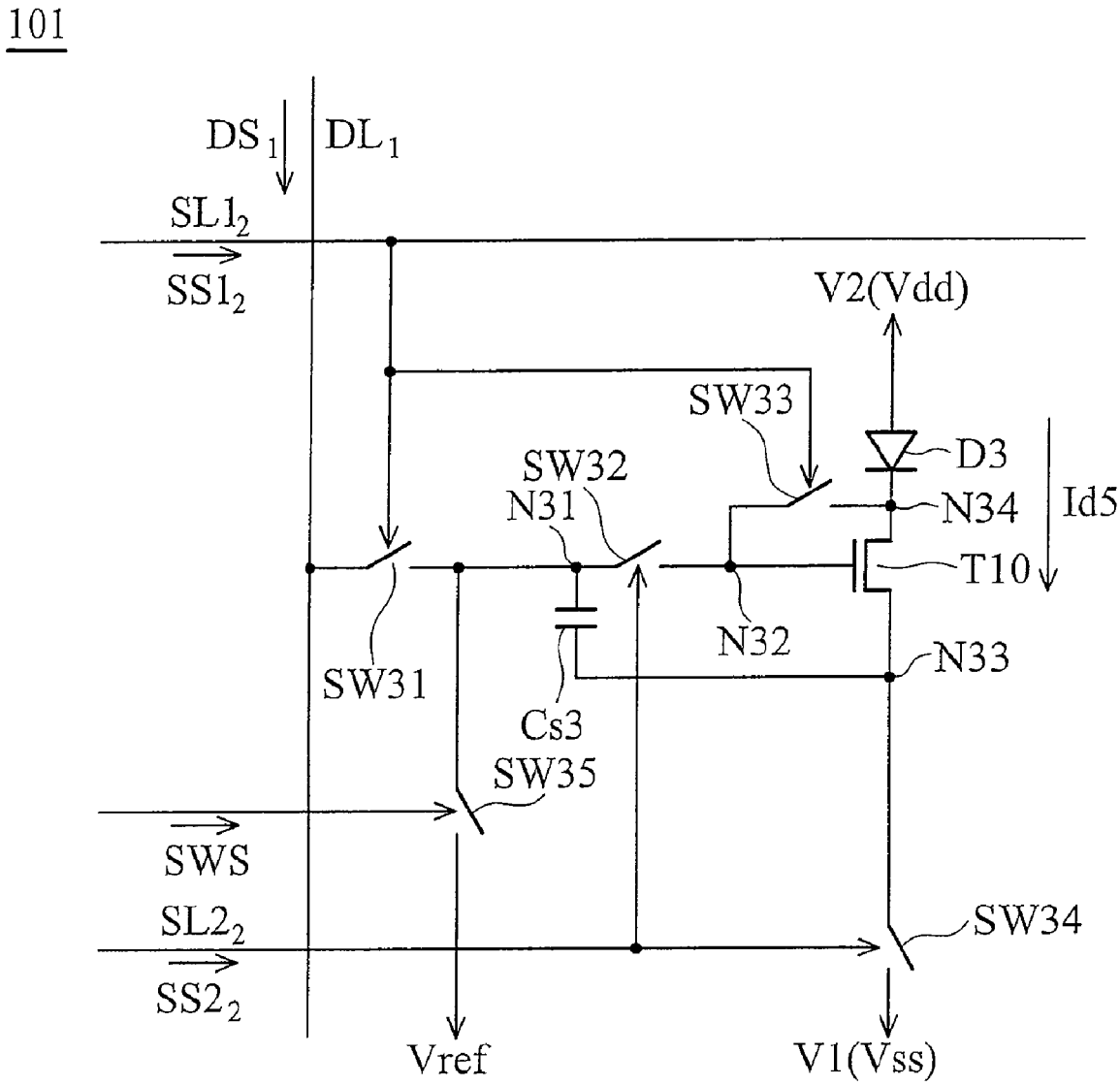
FIG. 10 depicts a display unit according to an embodiment of the present invention.

In the described embodiments, the driving element T3 is implemented by a PMOS transistor; however, the invention is not limited thereto. A person of ordinary skill in the art will recognize that an NMOS transistor, as shown in FIG. 10, can implement the driving element T3. In some embodiments, as shown in FIG. 10, except for a driving element T10 implemented by an NMOS transistor, a display unit 101 comprises the same elements as the display unit 300, such as the first to fourth switch elements SW31 to SW34, the storage capacitor Cs3, and the light-emitting element D3. Because the driving element T10 implemented by an NMOS transistor replaces the driving element T3 implemented by a PMOS transistor, the circuit position of the display unit 101 is changed. Moreover, in the embodiment of FIG. 10, the first voltage source V1 is implemented by a voltage source Vss, while the second voltage source V2 is implemented by a voltage source Vdd.

When the signal timing in FIG. 4, FIG. 6, or FIG. 8 is applied in the display unit 101, Equation 5 is obtained as follows:

$$id5\propto=(vgs-vth)=(vds1-vdd+vd3) \quad \text{(Equation 5)}$$

where id5, vgs, vth, vds1, vdd, and vd3 represent a value of driving current Id5, a value of the gate-source voltage Vgs of the driving element T10, the threshold voltage of the driving element T10, the voltage value of the data signal $DS_1$, the voltage value of the voltage source Vdd, and the cross voltage between of the light-emitting element D3.

According to Equation 5, the threshold voltage of the driving element T10 does not affect the driving current Id5. In other words, the electrical difference of the driving transistors due to the fabrication process thereof does not affect the brightness of the light-emitting element D3, preventing uneven images. Moreover, according to Equation 5, the voltage source Vss does not affect the driving current Id5, preventing unequal brightness resulted from the disposition of the power lines.

Note that when the signal timing in FIG. 4 is applied in the display unit 101, the first and second scan signals $SS1_2$ and $SS2_2$ are at a high level for turning on the first to fourth switch elements SW31 to SW34 in the period PT41. At this time, the storage capacitor Cs3 is discharged through the voltage source Vss, so that the storage capacitor Cs3 stores a predetermined voltage.

By increasing the number of switch elements and the number of scan signals and controlling the data signals, uneven images caused by the electrical difference of the driving transistor are eliminated. Moreover, unequal brightness resulted from the disposition of the power lines is also prevented.

While the present invention has been described in terms of preferred embodiments, it is to be understood that the present invention is not limited thereto. Rather, it is intended to cover various modifications and similar arrangements as would be apparent to those skilled in the art. Thus, the scope of the appended claims should be accorded the broadest interpretation so as to encompass all such modifications and similar arrangements.

What is claimed is:

1. A display unit comprising:

a first switch element having a first terminal for receiving a data signal and a second terminal electrically coupled to a first node;

a second switch element having a first terminal electrically coupled to the first node and a second terminal electrically coupled to a second node;

a driving element having a control terminal electrically coupled to the second node, a first terminal electrically coupled to a third node, and a second terminal electrically coupled to a fourth node;

a storage capacitor electrically coupled between the first and third nodes;

a third switch element having a first terminal electrically coupled to the second node and a second terminal electrically coupled to the fourth node;

a fourth switch element having a first terminal electrically coupled to a first voltage source and a second terminal electrically coupled to the third node; and a light-emitting element electrically coupled between the fourth node and a second voltage source;

wherein the first and third switch elements are controlled by a first signal, and the second and fourth switch elements are controlled by a second signal.

2. The display unit as claimed in claim 1, wherein the first and second signals are inverse, and an enabling pulse of the second signal is delayed from an enabling pulse of the first signal for a predetermined period.

3. The display unit as claimed in claim 1, wherein when the first switch element is turned on in response to the first signal, the storage capacitor is discharged according to a reference level of the data signal.

4. The display unit as claimed in claim 3, wherein after the storage capacitor is discharged, the storage capacitor is charged according to a data level of the data signal.

5. The display unit as claimed in claim 1, further comprising a fifth switch element having a control terminal, an input electrically coupled to a first node, and a second terminal electrically coupled to a reference voltage source.

6. The display unit as claimed in claim 5, wherein the first and third switch elements are controlled by a first signal, and the second and fourth switch elements are controlled by a second signal.

7. The display unit as claimed in claim 5, wherein before the first switch element is turned on in response to an enabling pulse of the first signal, the fifth switch element is turned on, so that the storage capacitor is discharged according to the reference voltage source.

8. The display unit as claimed in claim 7, wherein when the first switch element is turned on in response to the enabling pulse of the first signal, the storage capacitor is charged according to the data signal.

9. The display unit as claimed in claim 5, wherein the fifth switch element is controlled by a switch signal, and an enabling pulse of the first signal follows an enabling pulse of the switch signal.

10. The display unit as claimed in claim 1, wherein all of the first to fourth switch elements are at a turned-on state in a predetermined period.

11. A display panel comprising:

a plurality of data lines disposed sequentially for respectively transmitting a plurality of data signals;

a plurality of first scan lines, disposed sequentially and interlaced with the data lines, for respectively transmitting a plurality of first scan signals;

a plurality of second scan lines, disposed sequentially and interlaced with the data lines, for respectively transmitting a plurality of second scan signals; and a plurality of display units disposed in a plurality of rows and columns, wherein the display units in one row are electrically coupled to the same first and second scan lines, and each display unit corresponds one set of the interlaced data line, first scan line, and second scan line and comprises:

a first switch element having a control terminal electrically coupled to the corresponding first scan line, a first terminal electrically coupled to the corresponding data line, and a second terminal electrically coupled to a first node;

a second switch element having a control terminal electrically coupled to the corresponding second scan line, a first terminal electrically coupled to the first node, and a second terminal electrically coupled to a second node;

a driving element having a control terminal electrically coupled to the second node, a first terminal electrically coupled to a third node, and a second terminal electrically coupled to a fourth node;

a storage capacitor electrically coupled between the first and third nodes;

a third switch element having a control terminal electrically coupled to the corresponding first scan line, a first terminal electrically coupled to the second node, and a second terminal electrically coupled to the fourth node;

a fourth switch element having a control terminal electrically coupled to the corresponding second scan line, a first terminal electrically coupled to a first voltage source, and a second terminal electrically coupled to the third node; and a light-emitting element electrically coupled between the fourth node and a second voltage source.

12. The display panel as claimed in claim 11, wherein for the display units in one row, the first and second scan signals are inverse, and an enabling pulse of the second scan signal is delayed from an enabling pulse of the first scan signal for a predetermined period.

13. The display panel as claimed in claim 11, wherein for each display unit, when the first switch element is turned on in response to the first scan signal, the storage capacitor is discharged according to a reference level of the data signal.

14. The display panel as claimed in claim 13, wherein for each display unit, after the storage capacitor is discharged, the storage capacitor is charged according to a data level of the data signal.

15. The display panel as claimed in claim 11 further comprising a fifth switch element having a control terminal, an input electrically coupled to the first node, and a second terminal electrically coupled to a reference voltage source.

16. The display panel as claimed in claim 15, wherein for each display, before the first switch element is turned on in response to an enabling pulse of the first scan signal, the fifth switch element is turned on, so that the storage capacitor is discharged according to the reference voltage source.

17. The display panel as claimed in claim 16, wherein for each display unit, when the first switch element is turned on in response to the enabling pulse of the first scan signal, the storage capacitor is charged according to the data signal.

18. The display panel as claimed in claim 15, wherein the control terminal of the fifth switch element receives a switch signal, and an enabling pulse of the first scan signal follows an enabling pulse of the switch signal.

19. The display panel as claimed in claim 11, wherein for each display unit, the first to fourth switch elements are at a turned-on state in a predetermined period.

20. The display panel as claimed in claim 11 further comprising:

a data driver for providing the data signals to the data lines;

a first scan driver for providing the first scan signals to the first scan lines; and a second scan driver for providing the second scan signals to the second scan lines.

* * * * *